US006293076B1

(12) United States Patent
Miller et al.

(10) Patent No.: US 6,293,076 B1
(45) Date of Patent: Sep. 25, 2001

(54) METHOD AND APPARATUS FOR AUTOMATICALLY POSITIONING A PNEUMATIC ENVELOPE OPENER

(75) Inventors: John Miller, Shelton, CT (US); William B. Riley, Alexandria, VA (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/407,339

(22) Filed: Sep. 29, 1999

(51) Int. Cl.[7] ..... B65B 11/48

(52) U.S. Cl. ..... 53/460; 53/569; 53/381.6; 493/25

(58) Field of Search ..... 493/478, 479, 493/25; 53/460, 381.3, 381.6, 386.1, 569

(56) References Cited

U.S. PATENT DOCUMENTS

| | | | | |
|---|---|---|---|---|
| 4,020,707 | | 5/1977 | Cuniberti | 74/37 |
| 4,333,300 | * | 6/1982 | Russell . | |
| 4,569,182 | * | 2/1986 | Leuvering . | |
| 4,789,295 | | 12/1988 | Boucher, Jr. et al. | 414/497 |
| 4,878,417 | | 11/1989 | Facon | 91/363 R |
| 4,934,892 | * | 6/1990 | Smith et al. . | |
| 5,052,168 | * | 10/1991 | DeWitt et al. . | |
| 5,337,541 | * | 8/1994 | Gmuer . | |
| 5,408,811 | | 4/1995 | Satake et al. | 53/569 |
| 5,474,414 | * | 12/1995 | Tovini et al. . | |
| 5,722,221 | | 3/1998 | Maltman et al. | 53/493 |
| 5,910,090 | * | 6/1999 | Taute . | |

* cited by examiner

*Primary Examiner*—Eugene Kim
(74) *Attorney, Agent, or Firm*—Steven J. Shapiro; Michael E. Melton

(57) ABSTRACT

An apparatus and method for automatically positioning a plurality of suction devices over the throat of envelope to lift the throat. The apparatus includes: a base section pivotably mounted on a pivot shaft; a carriage movably mounted on the base section; a pair of pivot arms, wherein one end of each pivot arm is pivotably mounted on the carriage, and the other end extends out of the carriage for mounting an inner suction device; two outer arms movably mounted on the pivot shaft on opposite sides of the base section for mounting two outer suction devices; and means for rotating the pivot arms in order to adjust the distance between the two inner suction devices, moving the carriage in order to adjust the distance between the inner suction devices and the pivot shaft, and transporting the outer arms in opposite directions relative to the base station to adjust the distance between the outer suction devices so as to position the suction devices over the throat of the envelope according to width and the throat profile of the envelope. The apparatus further includes means for entering information regarding the width and throat profile; means for computing the locations of the suction devices; means for conveying the computed locations to the suction device placing mechanisms and means for pitching the outer arms and the base section about the pivot shaft to cause the suction devices to contact the throat of the envelope.

20 Claims, 10 Drawing Sheets

METHOD AND APPARATUS FOR AUTOMATICALLY POSITIONING A PNEUMATIC ENVELOPE OPENER

TECHNICAL FIELD

The present invention relates generally to a document inserting machine and, more specifically, an envelope opening device in the inserting machine.

BACKGROUND OF THE INVENTION

In an inserting machine for mass mailing, there is a gathering section where the enclosure material is gathered before it is inserted into an envelope. This gathering section is sometimes referred to as a chassis subsystem, which includes a gathering transport with pusher fingers rigidly attached to a conveying means and a plurality of enclosure feeders mounted above the transport. If the enclosure material contains many documents, these documents must be separately fed from different enclosure feeders. After all the released documents are gathered, they are put into a stack to be inserted into an envelope in an inserting station. Envelopes are separately fed to the inserting station, one at a time, and each envelope is placed on a platform facing down with its flap flipped back all the way. At the same time, mechanical fingers or vacuum suction device are used to keep the envelope on the platform while the throat of the envelope is pulled upward to open the envelope. The stack of enclosure material is than automatically inserted into the opened envelope.

Before the envelope is spread open, a number of suction cups must be properly positioned at the throat of the envelope. The position of suction cups, relative to each other, must be adjusted in accordance with the size and the type of the envelope. FIG. 1A and FIG. 1B illustrate the different envelope sizes that require different placement of the suction cups in order to properly lift the throat of the envelope. In FIG. 1A, there is shown a small envelope 100 having a relatively large flap 102 and a deep throat 104. In FIG. 1B, there is shown a large envelope 100 having a relatively shallow throat 104. Where four suction cups are used to lift the throat 104 at four pickup points A, B, C, D to spread open the envelope, it is preferred that the pickup points A, B, C, D be evenly spaced around the throat 104. In FIG. 1A, the pickup points A, B, C, D spread out more in the Y direction because of the deep throat 104. But in FIG. 1B, the pickup points A, B, C, D spread out more in the X direction because of the width, W, of the envelope. The distance between two adjacent suction cups can be, for example, determined by $$X_2=(W-2X_1)/3$$

$$Y_2=X_2 \tan\alpha$$

where $\alpha$ is the slope angle of the throat 104 and $X_1$ and $Y_1$ can be a distance ranging from 0.3" to 0.6" (7.6 mm to 15.2 mm).

It is, therefore, desirable to have an envelope opening device wherein the associated suction cups can be adjusted to match a wide range of envelope sizes and throat configurations.

SUMMARY OF THE INVENTION

The present invention provides a method and an apparatus for automatically positioning a plurality of suction cups over the throat of an envelope in an envelope inserting station and lifting the throat to spread open an envelope for material insertion or extraction.

The apparatus includes: a base section pivotably mounted on a pivot shaft; a carriage movably mounted on the base section; a moving mechanism for moving the carriage in a direction substantially perpendicular to the pivot shaft; a pair of pivot arms, wherein one end of each arm is pivotably mounted on the carriage, and the other end extends out of the carriage for mounting a suction cup; a rotation mechanism for rotating the pivot arms in opposing directions so as to position the suction cups over the throat of the envelope according to the width and the throat profile of the envelope; and a pitching device for pitching the base section about the pivot shaft to cause the suction cups to contact the throat of the envelope.

For lifting wide envelopes, it is preferred that the apparatus further includes: two outer arms movably mounted on the pivot shaft on opposite sides of the base section for mounting two additional suction cups; a transporting device for transporting the outer arms in opposite directions relative to the base station to position the additional suction cups over the throat of the envelope according to width and the throat profile of the envelope; and a pitching device for pitching the outer arms about the pivot shaft to cause the additional suction cups to contact the throat of the envelope.

Preferably, the apparatus has a data entering device for entering information regarding the width and the throat profile of the envelope, an electronic processor for computing the preferred location of each of the suction cups and for conveying the computed locations to the moving mechanism, the rotation mechanism and the transporting device so that these movement mechanisms can position the suction cups according to the computed location.

The method of automatically placing a plurality of suction cups over the throat of an envelope for lifting the throat, includes the steps of: 1) providing two suction cups, each mounted on a respective pivot arm, wherein said pivot arms movably mounted a base section which is pivotably mounted on a pivot shaft; 2) moving the pivot arms in opposite direction relative to the base section to adjust the distance between suction cups; and 3) extending or shortening the base section in a direction substantially perpendicular to the pivot shaft to adjust the distance between the suction cups and the pivot shaft for placing the suction cups over the throat according to the width and the throat profile of the envelope.

For wide envelopes; it is preferred that the above method further includes the steps of: 4) providing two additional suction cups, each suction cup mounted on an outer arm, wherein the outer arms are movably mounted on the pivot shaft on opposite sides of the base section; 5) transporting the outer arms along a line substantially parallel to the pivot shaft and in opposite directions relative to the base section in order to adjust the distance between two additional suction cups according to the width and the throat profile of the envelope.

The above method further comprises the step of 6) pitching the base section and the outer arms about the pivot shaft to cause all the suction cups to contact the throat of the envelope.

Preferably, the above method further includes the steps of 7) entering information regarding the width and the throat profile of the envelope, 8) computing the preferred locations of the suction cups responsive to the information, and 9) conveying the computed locations to the suction cup moving mechanisms to cause the suction cup moving mechanisms to place the suction cups according to the computed locations.

The method and apparatus for automatically positioning a plurality of suction cups to spread open an envelope as described above uses a suction force to lift the throat envelope after the suction cups are caused to contact the throat of the envelope. It is understood that the suction cups are operatively connected to a vacuum source or a vacuum pump in a conventional manner.

The present invention will become apparent upon reading the following detailed description taken in conjunction with FIG. 2A to FIG. 10.

DETAILED DESCRIPTION

Figure 2A:
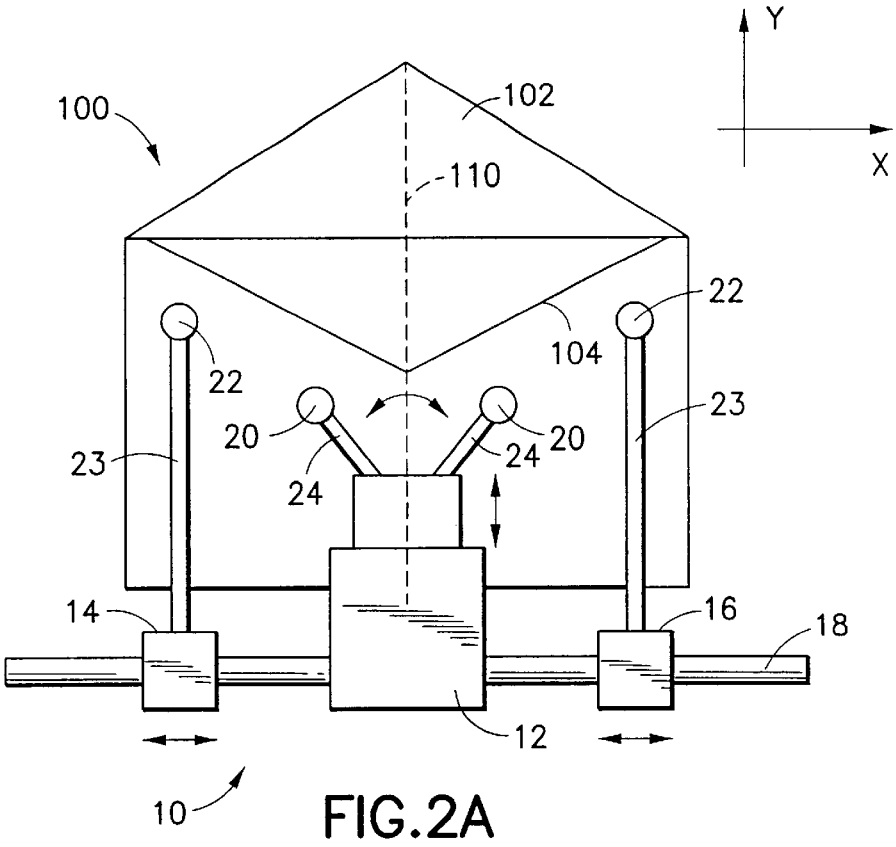
FIG. 2A and FIG. 2B illustrate the envelope opening device which can be adjusted to match different envelope sizes and throat configurations.
Figure 2B:
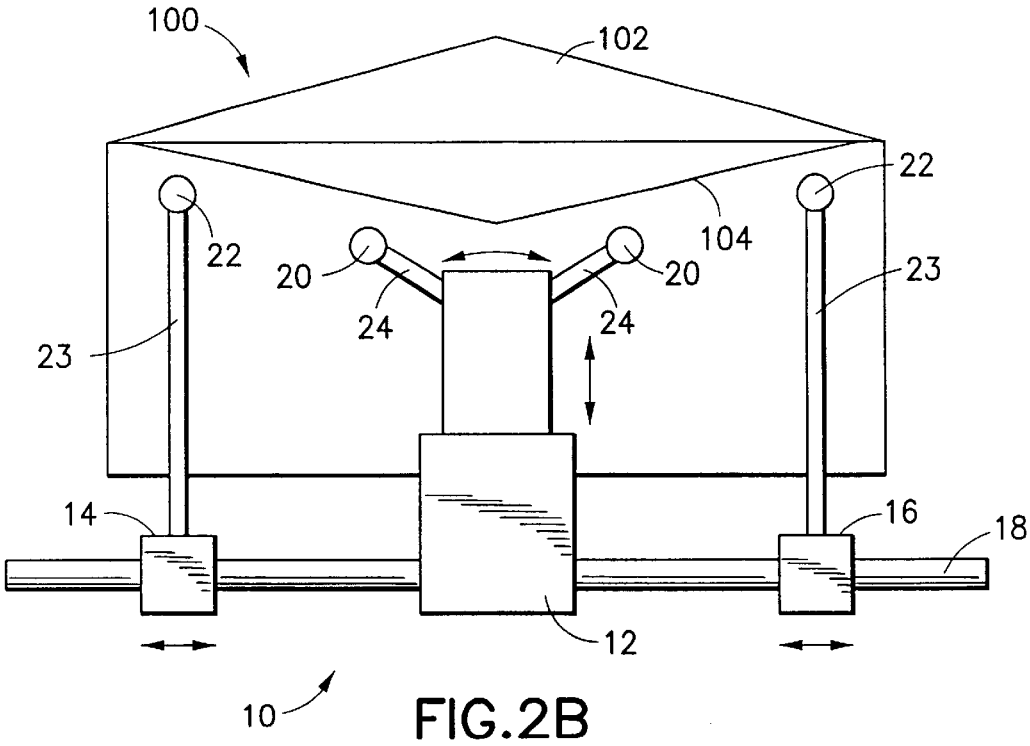

FIGS. 2A and 2B illustrate the envelope opening device 10, according to the present invention, for lifting the throat 104 of an envelope 100. The positions of suction cups 20, 22 are spread out in accordance with the size of the envelope and the throat configuration. In FIGS. 2A and 2B, there is shown a center station 12 on which the two center suction cups 20 are mounted. The center station 12 is pivotably mounted on a pivot shaft 18 such that the center station 12 is fixed in translation, but it can be caused to rotate about the pivot shaft 18. As shown, each of the center cups 20 is mounted on a pivot arm 24 so that the center cups 20 can be moved closer to or further from each other along the X direction. The center cups 20 can be caused to move closer to or further from the shaft pivot 18 along the Y direction. Each of the two outer cups 22 is mounted to an outer arm 23 having, preferably, a fixed length. It is also preferred that the outer arms 23 be mounted on the pivot shaft 18 along with the center station 12 so that they can also be caused to rotate about the pivot shaft 18 simultaneously with the center station 12. Thus, the two center cups 20 and the two outer cups 22 can be pitched up and down at the same time to lift the throat 104 of envelope 100. This pitching motion allows the suction cups 20, 22 to alternately seal the envelope 100, open the throat 104 and then return down for the next envelope 100. The two outer arms 23 can also be caused to move closer to or further away from each other along the X direction to match the width of the envelope. It is preferred that the two center suction cups 20 be allowed to be "mirrored" about a center line 110, as are the two outer suction cups 22. This symmetrical arrangement about the center line reduces the number of actuators needed for positioning the suction cups.

Figure 3:
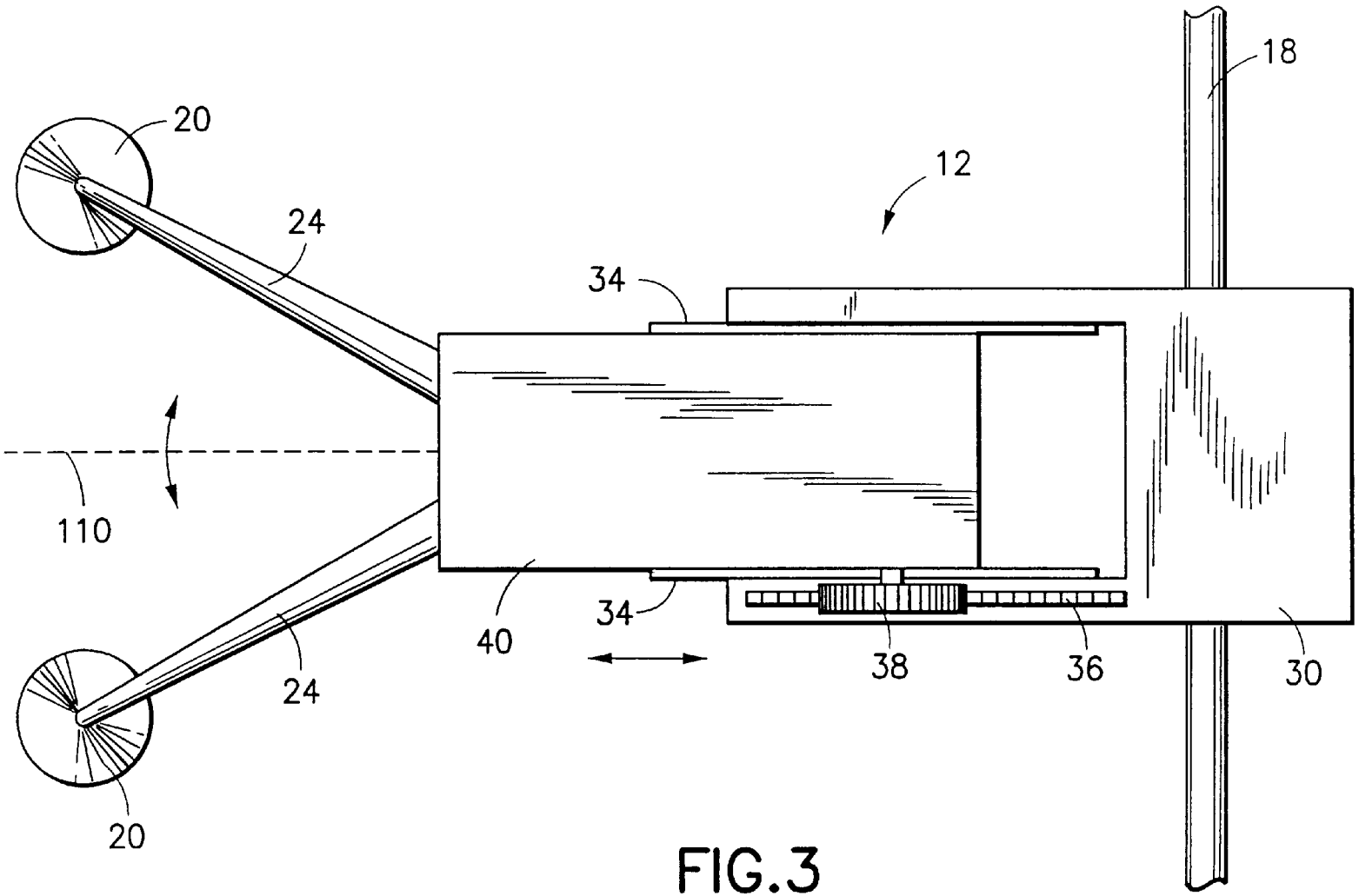
FIG. 3 illustrates the top view of a center station for positioning the positions of the two center suction cups.

FIG. 3 illustrates a top view of the center station 12 of the envelope opening device 10. As shown, center station 12 consists of two main parts. One is a base section 30 which can be caused to rotate about the pivot shaft 18; the other is a movable carriage 40 which can be caused to move in and out in a direction substantially perpendicular to the pivot shaft 18. It is possible that carriage 40 is mounted to move on small rails 34, in a direction which is substantially perpendicular to the pivot shaft 18. Extending outward from carriage 40 on the far end thereof from the pivot shaft 18 are two pivot arms 24, each having a suction cup 20 attached thereon. Preferably, pivot arms 24 are capable of moving in a manner that sweeps out an equal arc in opposing directions about the center line 110.

Figure 4:
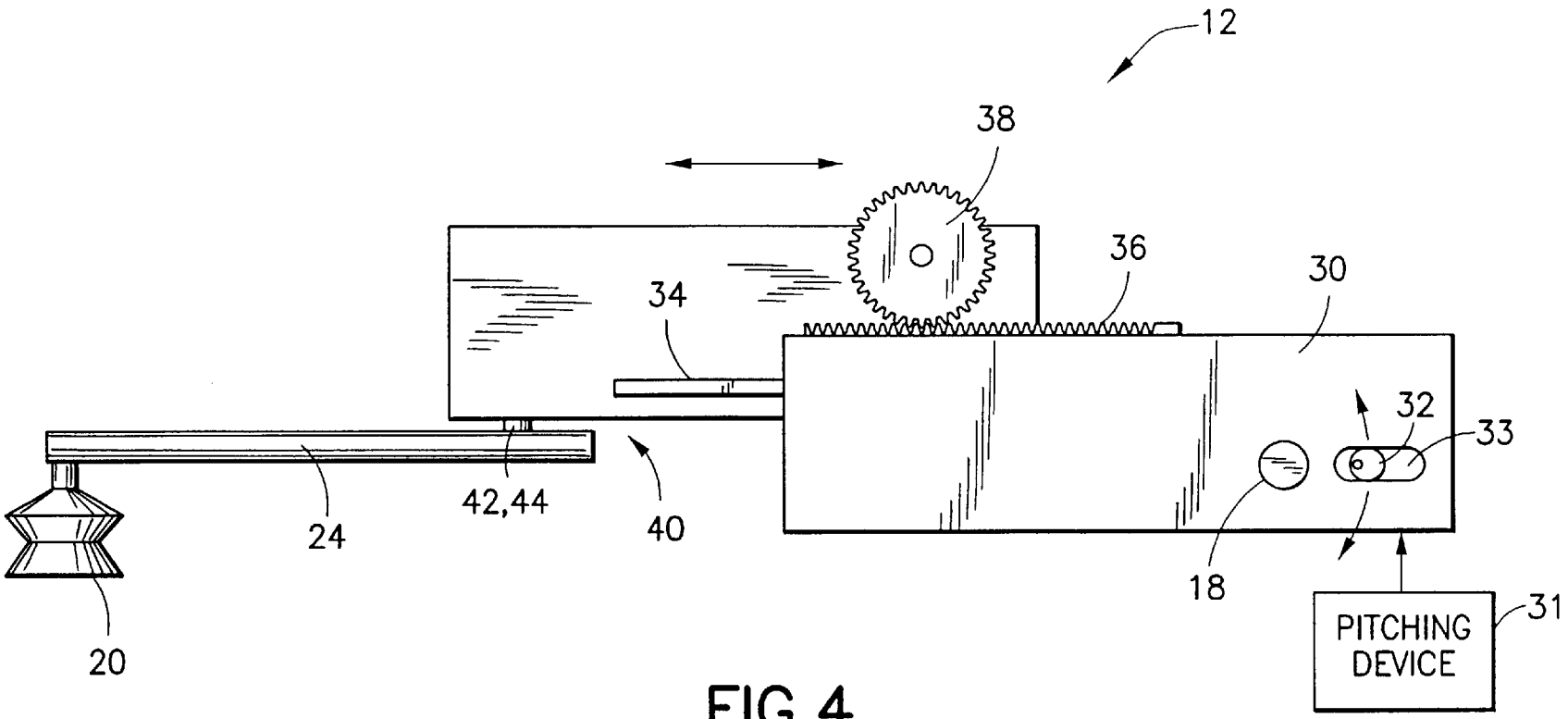
FIG. 4 illustrates the side view of the center station.
Figure 5:
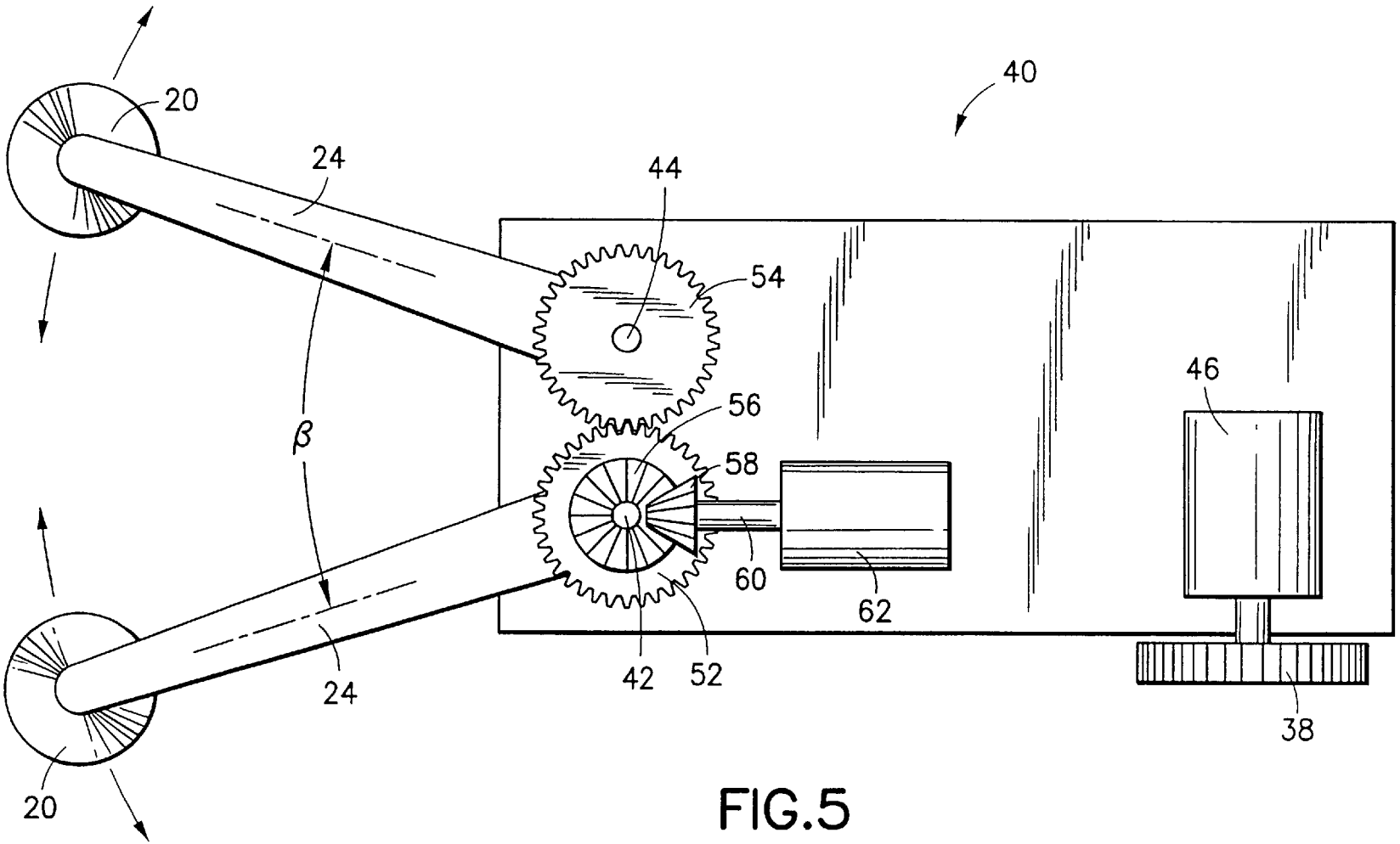
FIG. 5 illustrates the preferred embodiment of the mechanism for positioning the suction cups.
Figure 9:
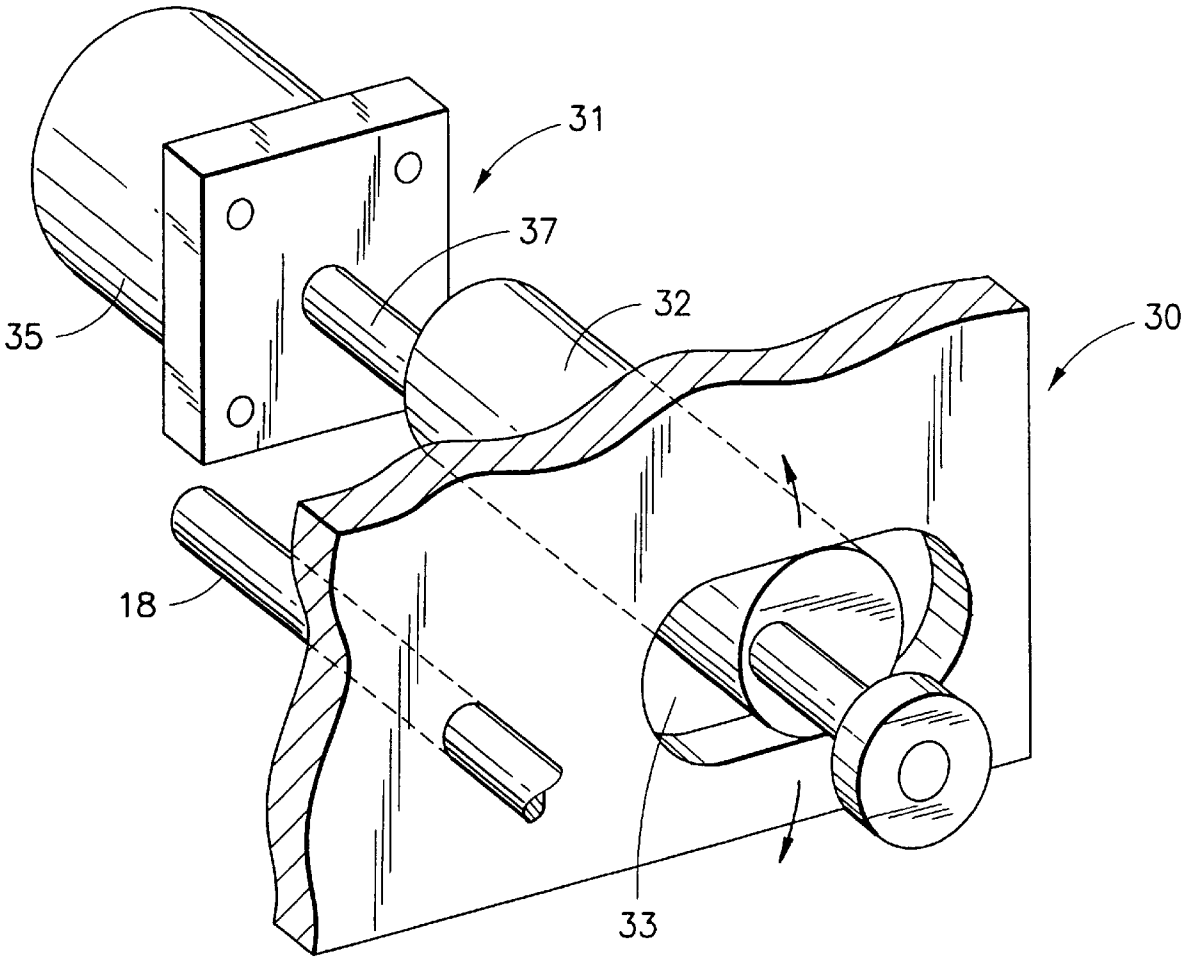
FIG. 9 illustrates an pitching device.

FIG. 4 shows a side view of the center station 12. As shown in FIG. 4, the movement of carriage 40, relative to base section 30, is caused by a rack and pinion pair 36, 38. As shown, pinion 38 is rotatably attached to carriage 40 and is mechanically engaged with a mold-in rack 36 on base section 30. The pinion 38 is driven by a servo motor 46 which is shown in FIG. 5. Preferably, a pitching shaft 32, which is eccentric and placed parallel to pivot shaft 18 through a slot 33, sweeps out a circular arc about the pivot shaft 18. This sweeping motion, caused by a pitching device 31, is used to consecutively cause the center station to pitch up to allow an envelope (not shown) to be placed under the suction cups 20; down to cause the suction cups 20 to seal with the throat of an envelope (not shown); and up again to lift the throat of the envelope. An exemplary pitching device 31 and the pitching shaft 32 are shown in FIG. 9.

FIG. 5 illustrates the preferred embodiment of the carriage 40. As shown, servo motor 46 is mounted on carriage 40 for driving pinion 38 in order to move the carriage 40 relative to the base section 30 (see FIGS. 3 and 4). Two matching spur gears 52, 54 are attached to respective pivot arms 24 and mounted on two mutually parallel mounting shafts 42, 44, in a properly engaged manner. The spur gears 52, 54 move in dissimilar directions, as is the nature of gears, to cause the two pivot arms 24 to sweep out in opposite but equal circular arcs about the respective mounting shafts 42, 44. Furthermore, a bevel gear 56 is fixedly attached to spur gear 52 and rotatably mounted on mounting shaft 42 for movement. A similar bevel gear 58 is fixedly attached on a drive shaft 60 which is driven by another servo motor 62 on carriage 40. As motor 62 turns, it transmits its power to drive shaft 60 to change the angle, $\beta$, between the two pivot arms 24. It is preferred that bevel gear 56 be molded right on top of spur gear 52 which is also integrally molded with the respective pivot arm 24. Similarly, it is preferred that spur gear 54 be integrally molded with the other pivot arm 24.

Figure 6:
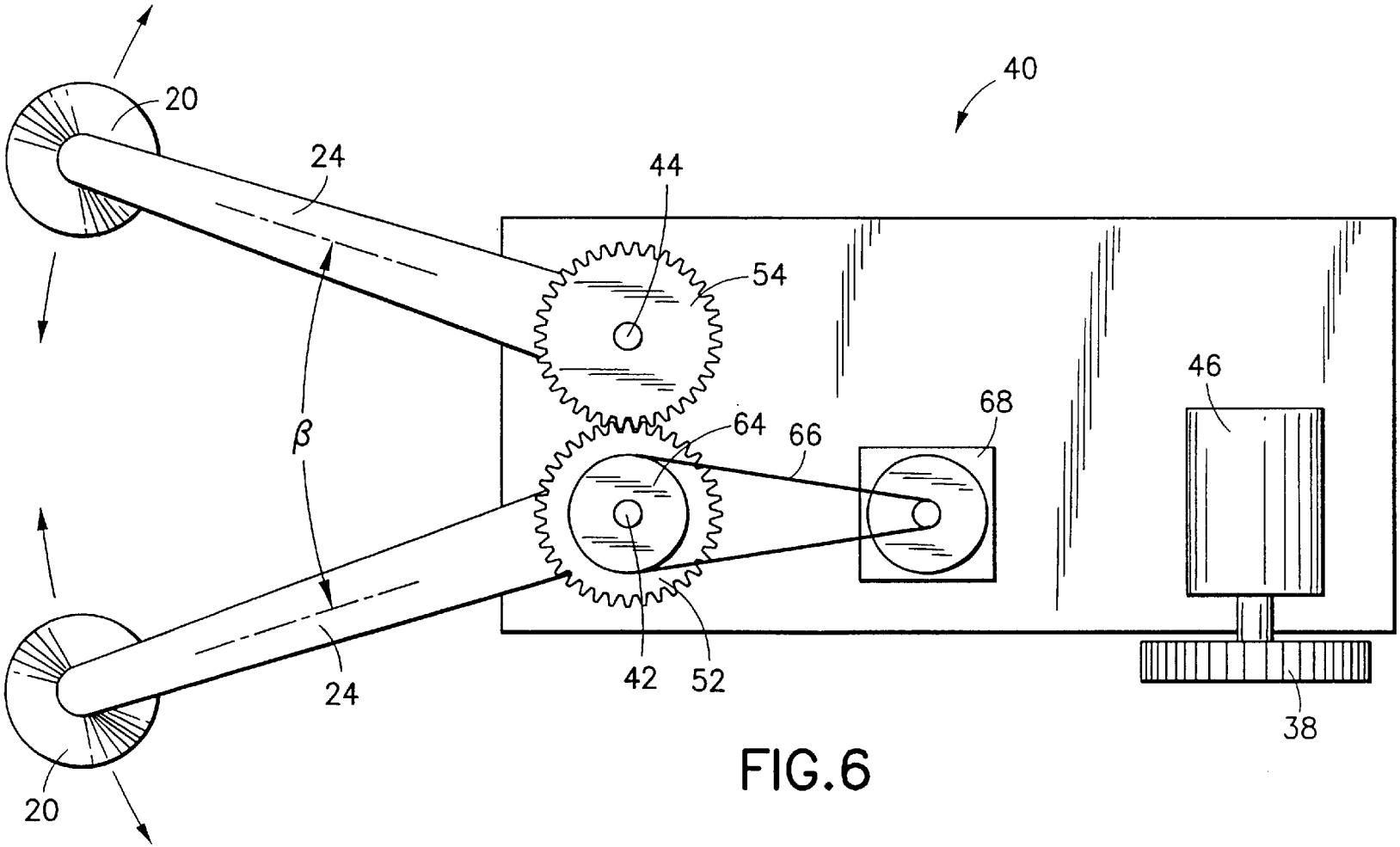
FIG. 6 illustrates another embodiment of the positioning mechanism.

FIG. 6 illustrates another embodiment of the carriage 40. Instead of bevel gears, a pulley 64 and a timing belt 66 driven by a servo motor 68 are used to turn the pivot arms.

Figure 7:
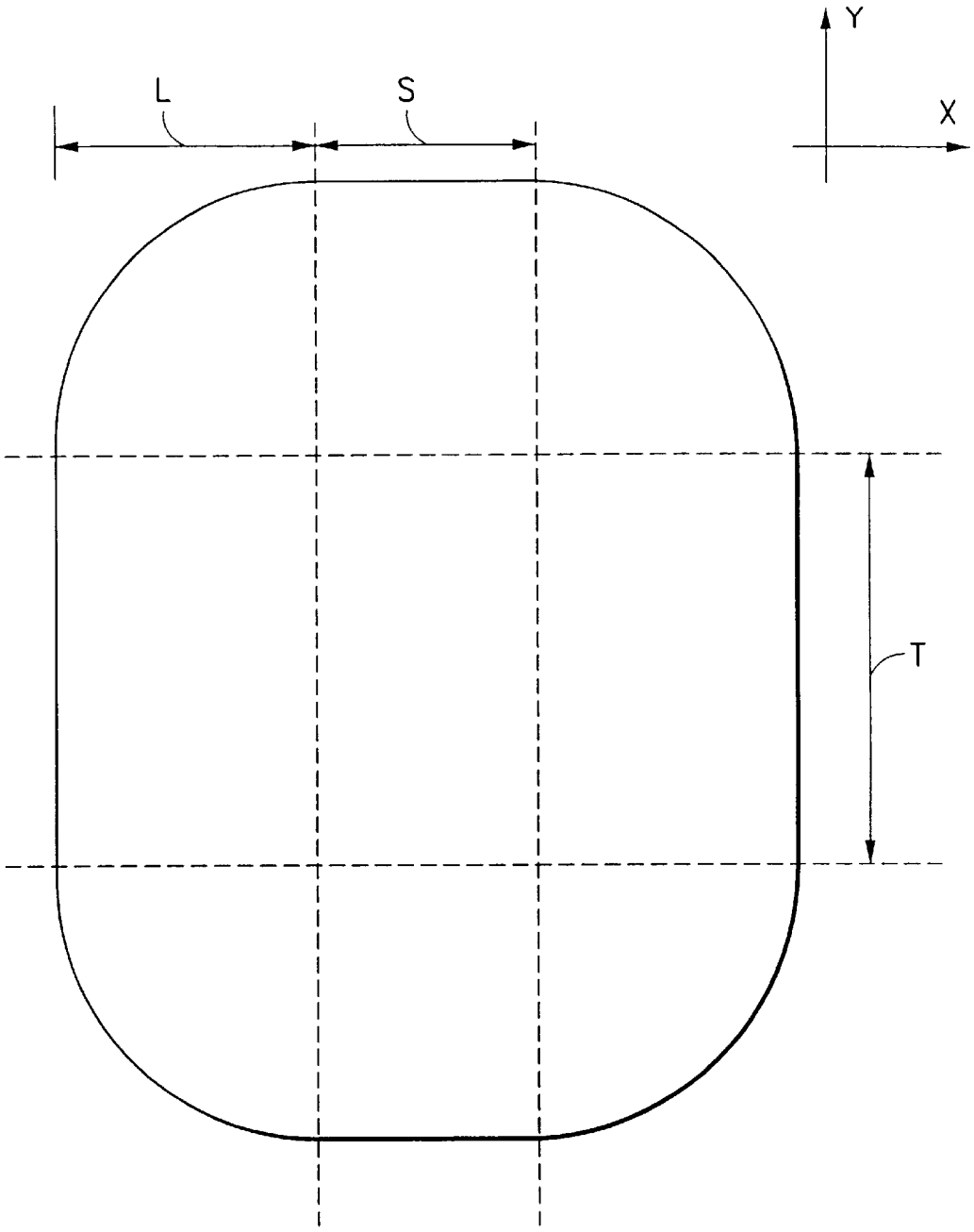
FIG. 7 illustrates the area that can be covered by the two suction cups of the center station.

The motion of servo motors 62, 68 can vary between about 60 degrees and 180 degrees, but any value in this range is acceptable. With the greater angle, a larger pickup area can be covered by the pivot arms 24. If the system is configured to use 180-degree servo motors, the area which can be covered for lifting the envelope throat 104 would have the shape as outlined in FIG. 7. As shown in FIG. 7, the three primary characteristics in determining the covered area are: 1) the arm length L which is the distance from the center of spur gears 52, 54 on the pivot arms 24 to the center of the respective suction cups 20; 2) the diameter S of spur gears 52, 54; and 3) the amount T of travel of the carriage 40 permissible by the rack-and-pinion pair 36, 38, relative to base section 30 as shown in FIGS. 3 and 4. The arm length L influences the maximum width of the area on which the suction cups 20 can be positioned. An arm length L approximately equal to ⅓ of the envelope width has been used as a quick rule-of-thumb. The gear diameter S influences the maximum distance between the two center suction cups 20 that can be stretched. Finally, the carriage travel distance T determines the maximum distance from the flap 102 of the envelope 100 that can be registered by the suction cups 20.

The coverage above is not the most general case, but it is a good approximation for most relationships between the critical parameters that should be encountered. It is possible to decrease the coverage in limiting cases where the parameters become quite different from those shown above.

Figure 8:
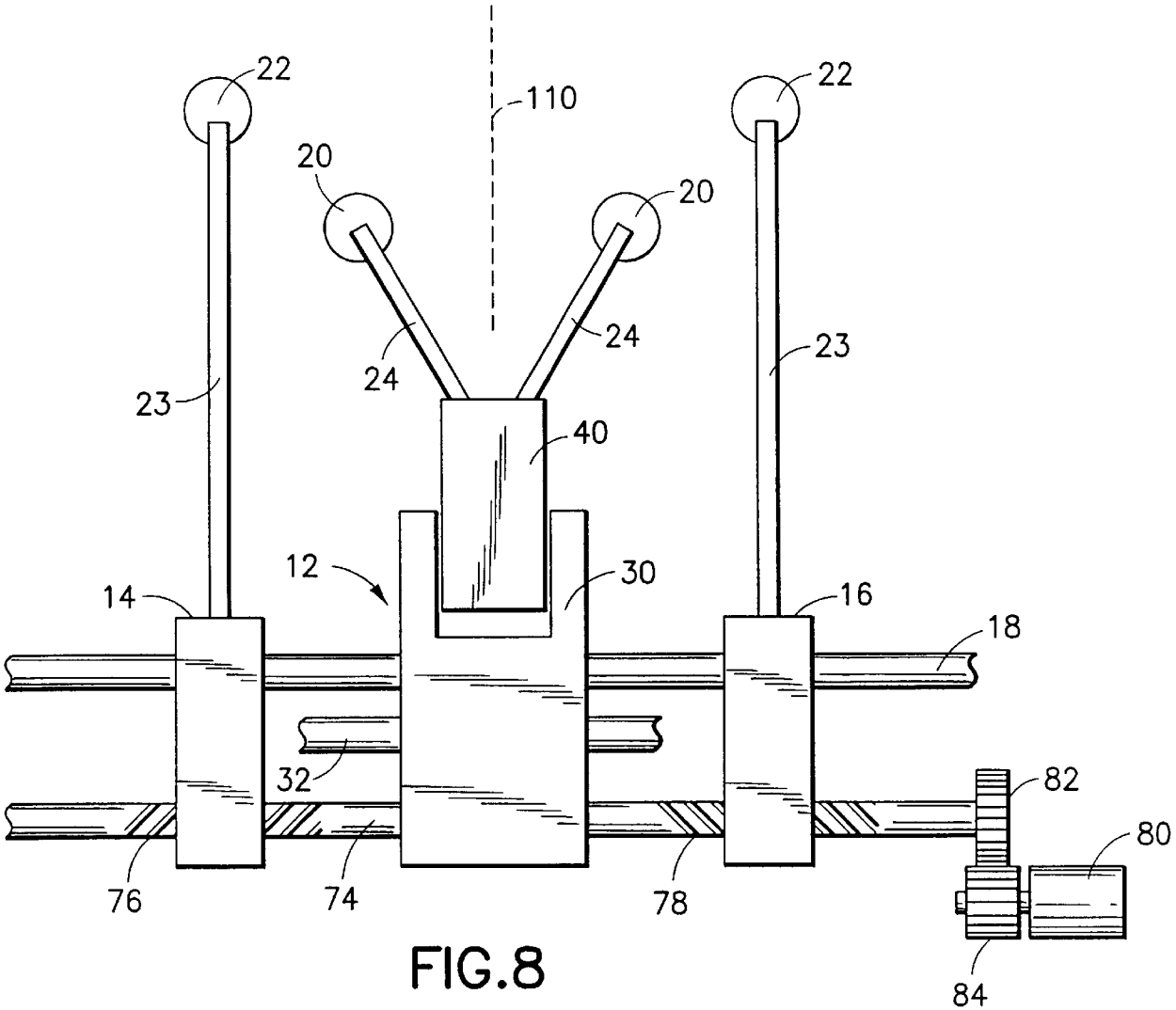
FIG. 8 illustrates the positioning of the two outer suction cups for lifting the throat.

For narrow envelopes, it may be adequate to use only the two center suction cups 20 to lift the throat 104 for opening the envelope 100. However, for envelopes exceeding a certain width, such as 3.5"×6" (88 mm×152 mm), it is preferable to use four suction cups 20, 22 to lift the throat, as shown in FIGS. 2A and 2B. In this case, it is preferable that the two outer arms 23 be located on opposite sides of the center station 12 (FIGS. 2A and 2B) for positioning the outer suction cups 22. As shown in FIG. 8, two outer arms 23 are, respectively, attached to outer bases 14 and 16. The two outer arms 23 are arranged such that they move in and out together in opposite directions. There are several ways to accomplish the movement of the outer arms 23. One way is to use a motor 80 to turn a drive shaft 74 on which the outer bases 14, 16 are mounted. The drive shaft 74 has threads cut into it. The threads on one side 76 of the drive shaft 74 are right-handed and the other side 78 are left-handed, for example. As motor 80 rotates, the two outer arms 23 either move closer to the center or move farther apart. As shown in FIG. 8, drive shaft 74 and motor 80 are mechanically engaged through gears 82 and 84. However, motor 80 can directly drive shaft 74, without using gears. There are no threads cutting into the center portion of the drive shaft 74 where it runs through the base section 30 of the center station 12 and, therefore, the turning of the drive shaft 74 does not cause any movement of the center station 12. However, since the base section 30 and the outer bases 14, 16 share the same pivot shaft 18 and the drive shaft 74, it is possible to cause the outer cups 22 to be raised or lowered together with the center cups 20. Also shown in FIG. 8 is a pitching shaft 32 for pitching the center station 12 up and down.

Another way to accomplish the movement of the two outer arms is with a rack-and-pinion system. The rack can either be integral to the drive shaft 74 or located above it. In this case, two servo motors, one per outer arm, would be needed for motion and feedback.

FIG. 9 illustrates a pitching device 31 for pitching the center station 12 up and down using shaft 18 as pivot as shown in FIG. 4. As shown in FIG. 9, pitching device 31 comprises a motor 35 for driving a drive shaft 37. If the center station 12 and the outer bases 14, 16 share the same pivot shaft 18 and the drive shaft 74 as shown in FIG. 8, then the two outer suction cups 22 are caused to move up or down together with the two center cups 20 by the same pitching device 31. The drive shaft 37 is fixedly mounted on the pitching shaft 32 in an eccentric manner. The pitching shaft 32 is fitted through slot 33 on the base section 30. When the motor 35 turns, the pitching shaft 32 rotates in the slot 33 accordingly. Consequently, the base section 30 is caused to move up and down relative to the drive shaft 37. If the pivot shaft 18 is fixedly positioned relative to the drive shaft 37 and the motor 35, the center station 12 and the outer bases 14, 16 will be caused to simultaneously pitch up and down using pivot shaft 18 as pivot. The pitching angle for the center station 12 and the outer bases 14, 16 can be controlled by varying the angle through which the motor 35 would turn, or by varying the eccentricity or the diameter of the pitching shaft 32.

Figure 1A:
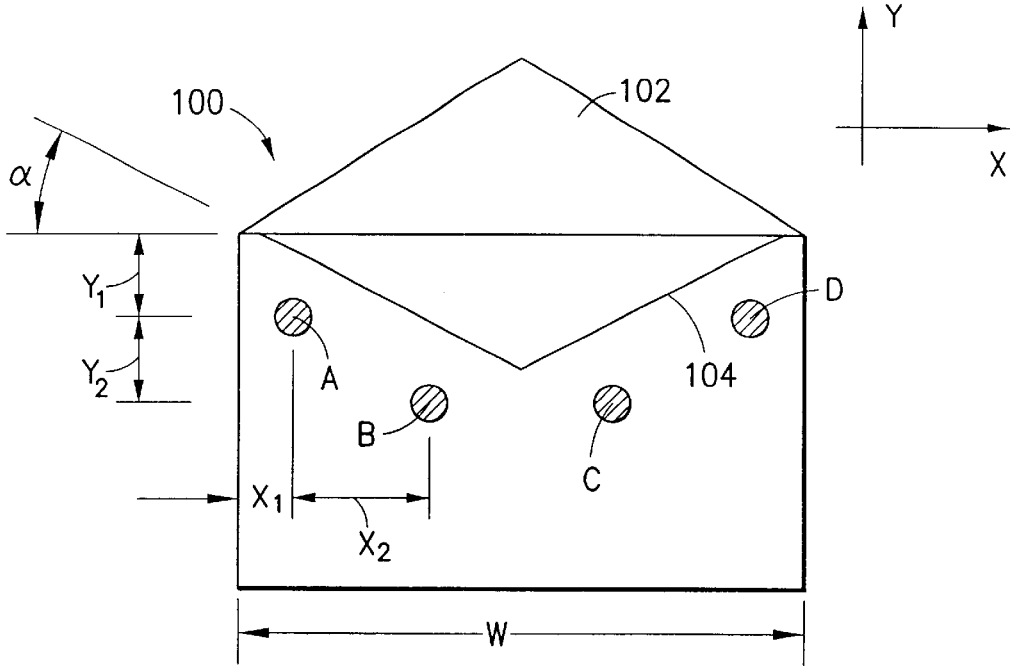
FIG. 1A and FIG. 1B illustrate two envelopes having different sizes and different throat configurations, and each having four pickup points around the throat.
Figure 1B:
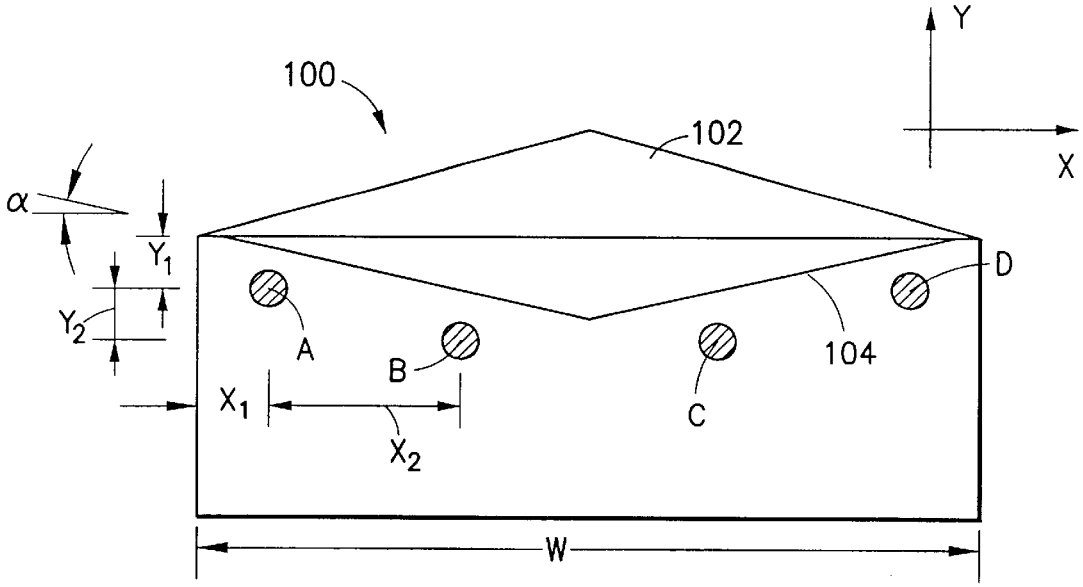
Figure 10:
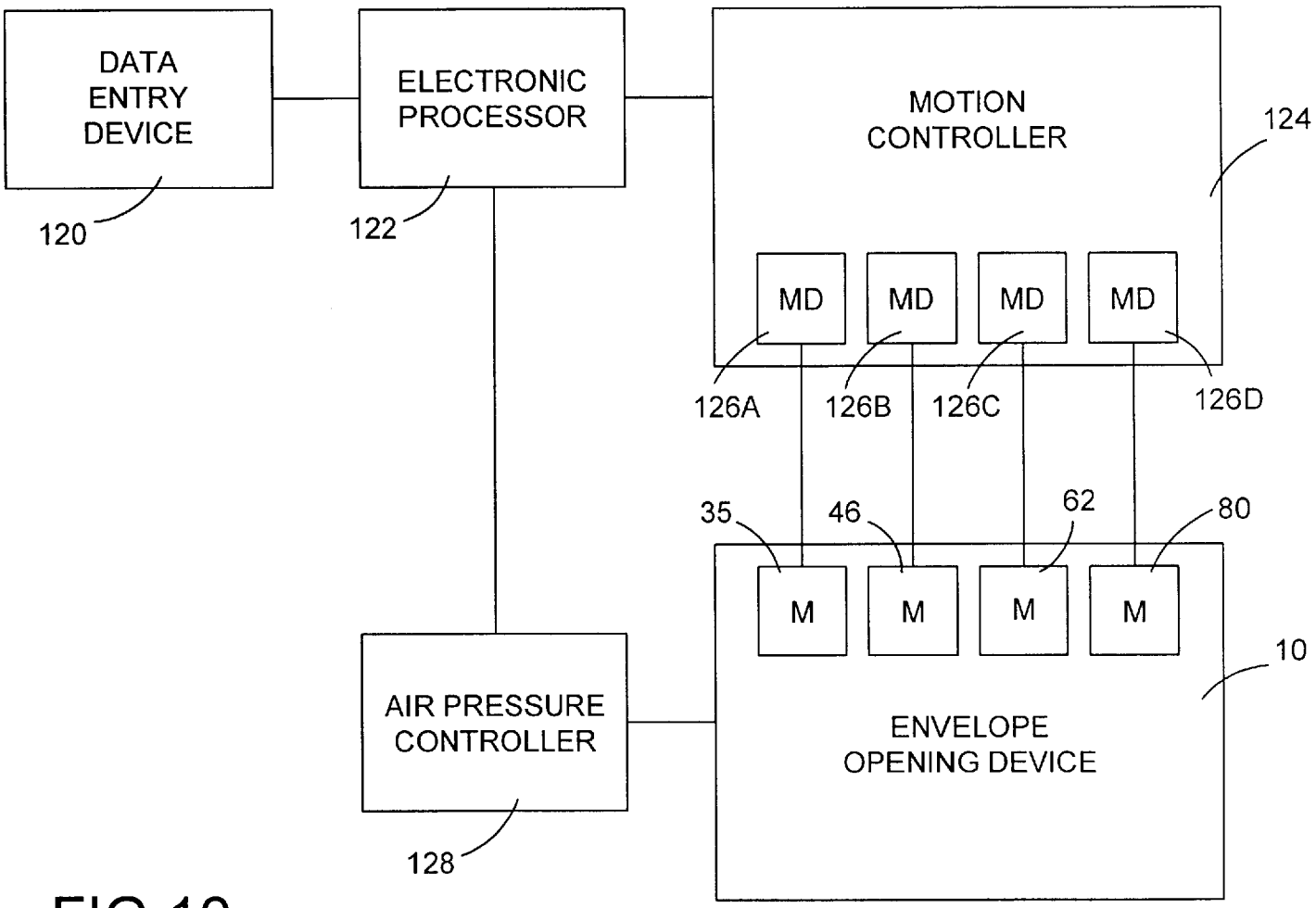
FIG. 10 illustrates a central system for controlling the opening of envelopes.

FIG. 10 is a block diagram showing the essential components in a central system for controlling the opening of envelopes in an envelope opening station. As shown in FIG. 10, a data entry device 120 is used for entering information regarding the width, W, and the throat profile of the envelope to an electronic processor 122. For example, the throat profile, as shown in FIGS. 1A and 1B can be represented by the slope angle, α, of the throat 104. If four suction cups are used to lift the throat of an envelope and they are evenly spaced over the throat, then the distance between two adjacent suction cups can be, for example, determined by $$X_2=(W-2X_1)/3$$

$$Y_2=X_2 \tan\alpha$$

where α is the slope angle of the throat 104 and $X_1$ and $Y_1$ can be a distance ranging from 0.3" to 0.6" (7.6 mm×15.2 mm), as illustrated in FIGS. 1A and 1B. Accordingly, the preferred location of each suction cup can be computed by the electronic processor 122 and conveyed to a motion controller 124. For example, the electronic processor 122 can be an electronic computer and the data entry device 120 can be a keyboard connected to the computer. Through an RS232 port of the computer, the computer can convey the computed locations to a plurality of motor drivers 126A, 126B, 126C and 126D in the motion controller 124 to control motors 35, 46, 62, 80 (see FIGS. 5, 8 and 9). Furthermore, the electronic processor 122 can be used to control an air pressure controller 128 which provides a suction force to each of the suction cups 20, 22 after the suction cups are caused to press against the throat 104 of an envelope 100 in order to spread open the envelope 100. The air pressure controller 128 may include one or more vacuum pumps which are operatively connected to suction cups 20, 22 to provide the suction force when needed.

It should be noted that the present invention has been described with respect to the preferred embodiments thereof and the drawings are for illustrative purposes only. For example, the number of suction cups can be different from two or four. Furthermore, the method of using a movable carriage with pivotable arms in a center station is applicable in an envelope opening device or other similar devices. Therefore, it will be understood by those skilled in the art that the foregoing and various other changes, omissions and deviations in the form and detail thereof may be made without departing from the spirit and scope of this invention.

What is claimed is:

1. In an envelope inserting station where envelopes are spread open for material insertion or extraction, wherein the envelope has a width and a throat having a throat profile, an apparatus for lifting the throat of the envelope, said apparatus comprising:

a base section pivotably mounted on a first shaft;

a carriage movably mounted on the base section;

means for moving the carriage in a first direction substantially perpendicular to the first shaft;

a first and a second pivot arm, each arm having a first end and an opposing second end, the first and second pivot arms pivotably mounted on the carriage at the first end, with the second end extending outward from the carriage;

a suction device mounted on the second end of each of the first and second pivot arms;

means for rotating the first and second pivot arms in opposing directions so as to position the suction devices over the throat of the envelope according to the width and the throat profile of the envelope;

means for pitching the base section about the first shaft to cause the suction devices to contact the throat of the envelope or to move away from the envelope; and means for entering information regarding the width and the throat profile of the envelope and means for computing the locations of the suction devices responsive to the information, wherein the rotating means positioning the suction devices in accordance with the locations so computed.

2. The apparatus of claim 1, wherein the rotating means causes each pivot arm to sweep out an arc in a plane which is substantially parallel to the first direction and the first shaft.

3. The apparatus of claim 1, wherein said moving means comprises a rack and a pinion mounted between the carriage and the base section; and a motor for moving the pinion relative to the rack.

4. The apparatus of claim 1, wherein each of the suction devices comprises a suction cup.

5. The apparatus of claim 1 further comprising at least one rail between the base section and the carriage to allow relative movement therebetween in the first direction.

6. The apparatus of claim 1, wherein the pitching device comprises a motor, a motor shaft fixedly connected to the motor, an eccentric member fixedly connected to the motor shaft for rotation wherein the eccentric member causes the base section to move using the first shaft as pivot in a plane substantially perpendicular to the first shaft.

7. The apparatus of claim 1, wherein the rotating means comprises a pair of matching spur gears, each of the spur gears mounted on the first end of a corresponding one of the first and second pivot arms, such that the spur gears are mechanically engaged to each other for turning in opposite directions so as to rotate the first and second pivot arms.

8. The apparatus of claim 7, wherein the rotating means further comprises a motor for causing the spur gears to turn.

9. The apparatus of claim 8, wherein the rotating means further includes a pulley and a belt, and the spur gear corresponding to the first pivot arm is mechanically engaged with the pulley so as to allow the motor to turn the spur gear via the belt and the pulley.

10. The apparatus of claim 7 further comprising:

a first bevel gear attached to the spur gear corresponding to the first pivot arm; and a second bevel gear mated to the first gear and engaged with a motor to turn the spur gears via the first bevel gear.

11. The apparatus of claim 1, wherein the computing means comprises an electronic processor.

12. The apparatus of claim 1, wherein the computing means comprises an electronic computer.

13. The apparatus of claim 1 further comprising:

two outer arms movably mounted on the first shaft on opposing sides of the base section:

two additional suction devices, each attached to a respective one of the outer arms; and means for transporting said outer arms in opposite directions relative to the base station in a direction substantially parallel to the first shaft in order to position the additional suction devices over the throat of the envelope according to the width and the throat profile of the envelope.

14. The apparatus of claim 13 further comprising means for pitching the two outer arms about the first shaft to cause the additional suction devices to contact the throat of the envelope.

15. The apparatus of claim 14, wherein the pitching device comprises a motor, a motor shaft fixedly connected to the motor, an eccentric member fixedly connected to the motor shaft for rotation wherein the eccentric member causes the base section and each of the two outer arms to move using the first shaft as pivot in a plane substantially perpendicular to the first shaft.

16. The apparatus of claim 13, wherein the transporting means comprises a drive shaft having on one side thereof right-handed threads to be engaged with one of the two outer arms and on other side thereof left-handed threads to be engaged with the other of the two outer arms; and means for turning the drive shaft to transport the outer arms.

17. The apparatus of claim 16, wherein the turning means comprises a motor.

18. The apparatus of claim 13, further comprising means for entering information regarding the width and the throat profile of the envelope, and means for computing the locations of the suction devices and the additional suction devices responsive to the information, wherein the rotating means and the transporting means positioning the suction devices and the additional suction devices respectively in accordance with the locations so computed.

19. In an envelope inserting station where envelopes are spread open for material insertion or extraction, wherein the envelope has a width and a throat having a throat profile, a method of placing a plurality of suction devices over the throat of the envelope in order to lift the throat, said method comprising the steps of:

1) providing two suction devices, each mounted on a respective pivot arm, wherein said pivot arms are movably mounted on a base section which is pivotably mounted on a pivot shaft;

2) moving said pivot arms to adjust the distance between the suction devices along a direction substantially parallel to the pivot shaft;

3) extending or shortening the base section in a direction substantially perpendicular to the pivot shaft to adjust the distance between the suction devices and the pivot shaft in order to position the suction devices over the throat of the envelope according to the width and the throat profile of the envelope;

4) entering information regarding the width and the throat profile of the envelope;

5) computing the locations of the suction devices responsive to the information so that the moving of the pivot arms in step 2 and the extending or shortening of the base section in step 3 can be carried out according to the computed locations; and 6) pitching the base section about the pivot shaft in order to cause the suction devices to seal with the throat of the envelope.

20. In an envelope inserting station where envelopes are spread open for material insertion or extraction, wherein the envelope has a width and a throat having a throat profile, a method of placing a plurality of suction devices over the throat of the envelope in order to lift the throat, said method comprising the steps of:

1) providing two suction devices, each mounted on a respective pivot arm, wherein said pivot arms are movably mounted on a base section which is pivotably mounted on a pivot shaft;

2) moving said pivot arms to adjust the distance between the suction devices along a direction substantially parallel to the pivot shaft;

3) extending or shortening the base section in a direction substantially perpendicular to the pivot shaft to adjust the distance between the suction devices and the pivot shaft in order to position the suction devices over the throat of the envelope according to the width and the throat profile of the envelope;

4) providing two additional suction devices, each additional suction device mounted on an outer arm, wherein the outer arms are movably mounted on the pivot shaft on opposite sides of the base section;

5) transporting the outer arms along a line substantially parallel to the pivot shaft and in opposite directions relative to the base section in order to adjust the distance between the additional suction devices in order to position the additional suction devices over the throat of the envelope according to the width and the throat profile of the envelope;

6) entering information regarding the width and the throat profile of the envelope;

7) computing the locations of the suction devices responsive to the information so that the moving of the pivot arms in step 2, the extending or shortening of the base section in step 3 and the transporting of outer arms in step 5 can be carried out according to the computed locations; and 8) pitching the base section about the pivot shaft in order to cause the suction devices to seal with the throat of the envelope.

* * * * *